US005093011A

United States Patent [19]

Friedman et al.

[11] Patent Number: 5,093,011

[45] Date of Patent: Mar. 3, 1992

[54] PROCESS FOR DEHALOGENATION OF CONTAMINATED WASTE MATERIALS

[75] Inventors: Arthur J. Friedman, Deerfield; Yuval Halpern, Skokie, both of Ill.

[73] Assignee: Chemical Waste Management, Inc., Oak Brook, Ill.

[21] Appl. No.: 626,068

[22] Filed: Dec. 12, 1990

[51] Int. Cl.[5] ..... C10G 17/00

[52] U.S. Cl. ..... 210/757; 208/262.1; 208/262.5; 210/909

[58] Field of Search ..... 210/749, 757, 909; 208/262.1, 262.5

[56] References Cited

U.S. PATENT DOCUMENTS

| | | | |
|---|---|---|---|
| 4,327,027 | 4/1982 | Howard et al. | 260/340.3 |
| 4,337,368 | 6/1982 | Pytlewski et al. | 568/730 |
| 4,349,380 | 9/1982 | Pytlewski et al. | 75/0.5 A |
| 4,351,978 | 9/1982 | Hatano et al. | 585/469 |
| 4,353,793 | 10/1982 | Brunelle | 208/262 |
| 4,387,018 | 6/1983 | Cook et al. | 208/262 |
| 4,400,552 | 8/1983 | Pytlewski et al. | 568/715 |
| 4,410,422 | 10/1983 | Brunelle | 208/262 |
| 4,417,977 | 11/1983 | Pytlewski et al. | 208/262.1 |
| 4,430,208 | 2/1984 | Pytlewski et al. | 208/262 |
| 4,447,541 | 5/1984 | Peterson | 435/264 |
| 4,460,797 | 7/1984 | Pytlewski et al. | 568/715 |
| 4,471,143 | 9/1984 | Pytlewski et al. | 568/715 |
| 4,483,716 | 11/1984 | Heller | 137/7 |
| 4,523,043 | 6/1985 | Pytlewski et al. | 568/840 |
| 4,602,994 | 7/1986 | Pytlewski et al. | 208/262.1 |
| 4,632,742 | 12/1986 | Tundo | 204/158.21 |
| 4,662,948 | 5/1987 | Weitzman | 134/25.1 |
| 4,663,027 | 5/1987 | Mendiratta et al. | 208/262 |
| 4,748,292 | 5/1988 | Mendiratta et al. | 585/469 |
| 4,764,256 | 8/1988 | Way | 203/46 |
| 4,776,947 | 10/1988 | Streck et al. | 208/262.1 |

FOREIGN PATENT DOCUMENTS

| | | | |
|---|---|---|---|
| 618189 | 10/1946 | United Kingdom | 570/226 |

OTHER PUBLICATIONS

Oshawa and Oishi, J. Inclusion Phenomena 2: 185–194 (1984).

Oshawa and Oishi, Tetrahedron Letters 22: 2583–2586 (1981).

Gokel, et al., J. Org. Chem. 48: 2837–2842 (1983).

Mariani, et al., J. Chem. Research (S) (1978), p. 392.

Litvak and Shein, Zhurnal Organicheskoi Khimii 12: 1723–1727 (1976).

Hiratani et al., Israel Journal of Chemistry 18: 208–213 (1979).

*Primary Examiner*—Peter Hruskoci

*Attorney, Agent, or Firm*—Allegretti & Witcoff, Ltd.

[57] ABSTRACT

An improved method for detoxifying waste materials contaminated with halogenated hydrocarbons is disclosed. The method achieves dehalogenation of such halogenated hydrocarbons in a manner as efficient as previous methods, but at a considerably lower cost. The economic advantages of the present invention arise from the use of lower temperatures and/or smaller quantities of reagents, which in turn is made possible by the discovery of a surprisingly superior reagent, 2-methoxyethanol, and superior catalysts, the crown ethers, which allow reagents other than 2-methoxyethanol to function very efficiently in dehalogenation reactions.

4 Claims, No Drawings

PROCESS FOR DEHALOGENATION OF CONTAMINATED WASTE MATERIALS

BACKGROUND OF THE INVENTION

1. Field of the Invention

The present invention relates to processes for dehalogenating waste or contaminated materials containing halogenated organic compounds, such as transformer oils, dielectric fluids, wood preservatives, halogenated by-products from the manufacture of halogenated herbicides and soils contaminated with discharges of these materials.

2. Information Disclosure Statement

Polychlorinated biphenyls (PCBs) have shown great utility for use in dielectric fluids, due to their outstanding thermal stability, resistance to oxidation and chemical agents, as well as excellent electrical insulating qualities. However, the discovery of PCBs in environmental samples and subsequent recognition of their potential toxic hazards resulted in restricted sales of PCBs to applications in closed electrical systems, and ultimately to the termination of PCB production in 1977.

PCBs represent only one of a large number of halogenated organic compounds that are currently stored for want of an economical and effective means of disposal. Storage of such chemicals, however, is only a stopgap measure. Storage capacity is not unlimited and the quantity of hazardous chemicals generated by industry continuously increases. Thus, effective and affordable methods for destroying halogenated organic compounds are needed.

The difficulty in decomposing halogenated organic compounds arises from the great stability of the carbon-halogen covalent bond. The energy of a carbon-chlorine bond, for example, is on the order of 84 kcal/mole. Thus, many halogenated organic compounds resist biodegradation as well as most chemical decomposition methods. Most known chemical methods achieve only partial dehalogenation, and involve the use of expensive reagents, inert atmospheres, elevated temperatures, complex apparatus, substantial energy consumption or other undesirable parameters. Physical means of disposal have similar problems. Incineration requires substantial energy consumption and complex equipment and may form residual ash, which may require additional treatment.

Thus, there is a need for effective and economical processes for the decomposition of halogenated organic compounds. Chemical processes have shown some promise for such applications. An ideal chemical process would allow very substantial dehalogenation of halogenated hydrocarbons at low cost, using limited reagent, time and energy resources.

The problems associated with disposal of halogenated organic compounds are well known in the art. Chemical processes for dehalogenation of various hydrocarbons have been described.

Howard et al., U.S. Pat. No. 4,327,027, describes a method for chemical detoxification of toxic chlorinated aromatic compounds comprising incubation of such compounds at elevated temperatures with an amount, in excess of stoichiometric, of alkali metal alcoholates of alkanols, alkoxyalkane glycols, alkanepolyols and monoalkyl ethers thereof.

Pytlewski et al., U.S. Pat. No. 4,349,380 discloses methods for recovering metals from chemically combined forms through the use of alkali metals with polyglycols with at least 4 carbon atoms, or polyglycol monoalkyl ethers with at least 5 carbon atoms, and oxygen.

Pytlewski et al., U.S. Pat. No. 4,337,368 relates to the use of alkali metals with polyglycols with at least 4 carbon atoms or polyglycol monoalkyl ethers with at least 5 carbon atoms and oxygen to decompose halogenated organic compounds.

Hatano et al., U.S. Pat. No. 4,351,978 relates to a method for dechlorination of PCB via hydrogenation, and employing an alkaline aqueous/alcohol solution, molecular hydrogen and a hydrogenation catalyst.

Brunelle et al., U.S. Pat. No. 4,353,793 discloses a method for removing PCBs from contaminated nonpolar organic solvents using monocapped polyalkyleneglycol alkyl ethers with alkali metal hydroxides.

Cook et al., U.S. Pat. No. 4,387,018 describes a method for extracting PCBs from oil using methanol. Pytlewski et al., U.S. Pat. No. 4,400,552 discloses a method for decomposing halogenated organic compounds using a reagent comprising the product of the reaction of an alkali metal hydroxide with a polyglycol with at least 4 carbon atoms or a polyglycol monoalkyl ether with at least 5 carbon atoms.

Pytlewski et al., U.S. Pat. No. 4,417,977 relates to methods for removing halogenated organic compounds from organic functional fluids through the use of alkali metals with polyglycols with at least 4 carbon atoms or polyglycol monoalkyl ethers with at least 5 carbon atoms and oxygen.

Pytlewski et al., U.S. Pat. No. 4,430,208 describes a three step process for the removal and detoxification of PCBs from contaminated dielectric fluids. The process comprises extraction with polyethylene glycol followed by extraction with cyclohexane, followed by incubation with a reagent derived from the reaction of sodium or sodium hydroxide, polyethylene glycol and oxygen.

Peterson, U.S. Pat. No. 4,447,541 discloses a method for reducing the halogen content of highly-halogenated organic soil contaminants through the use of an alkali reagent, such as an alkali metal hydroxide, an alkali metal hydroxide/alcohol or glycol mixture, or an alkoxide, in conjunction with a sulfoxide catalyst.

Tundo, U.S. Pat. No. 4,632,742 discusses a method for decomposing halogenated organic compounds through an anaerobic process using Nixolens (R), alcohols, polyethylene glycols or polyglycol monoalkyl ethers with at least 5 carbon atoms, together with an oxidizing agent.

Weitzman, U.S. Pat. No. 4,662,948 relates to a method for removing PCBs and dioxins from soils through extraction of soils with a mixture of halogenated hydrocarbons and a polar solvent.

Pytlewski et al., U.S. Pat. No. 4,460,797 discloses a method for the decomposition of halogenated organic compounds using a reagent comprising the product of the reaction of an alkali metal hydroxide with a polyglycol with at least 4 carbon atoms or a polyglycol monoalkyl ether with at least 5 carbon atoms.

Pytlewski et al., U.S. Pat. No. 4,471,143 relates to a composition of matter in liquid form comprising a coordination complex which is the product of the reaction of an alkali metal or alkali metal hydroxide with a polyglycol with at least 4 carbon atoms or a polyglycol monoalkyl ether with at least 5 carbon atoms.

Heller, U.S. Pat. No. 4,483,716 discusses processes for removing chemical substances, including halogenated organic compounds, from porous substrates, using a poultice comprising particulate matter and a volatile solvent, then destroying such halogenated hydrocarbons using the product of the reaction of an alkali metal or alkali metal hydroxide with a polyglycol with at least 4 carbon atoms or a polyglycol monoalkyl ether with at least 5 carbon atoms.

Pytlewski et al., U.S. Pat. No. 4,523,043 relates to reagents and methods for decomposition of organic sulfur-containing compounds through the cleavage of carbon-sulfur bonds using the product of the reaction of an alkali metal or alkali metal hydroxide with a polyglycol with at least 4 carbon atoms or a polyglycol monoalkyl ether with at least 5 carbon atoms.

Pytlewski et al., U.S. Pat. No. 4,602,994 discloses a method for the removal of halogenated organic compounds from organic functional fluids using, in an inert atmosphere, the product of the reaction of an alkali metal or alkali metal hydroxide with a polyglycol with at least 4 carbon atoms or a polyglycol monoalkyl ether with at least 5 carbon atoms.

Mendiratta et al., U.S. Pat. No. 4,663,027 relates to a method for removing polyhalogenated hydrocarbons from nonpolar organic solutions by admixing flakes or pellets of an alkali metal hydroxide with such a solution to form a slurry of alkali metal hydroxides of uniform size, followed by reacting such slurry with a polyalkylene glycol or a monocapped polyalkylene glycol alkyl ether.

Mendiratta et al., U.S. Pat. No. 4,748,292 discloses a method for removing polyhalogenated hydrocarbons from nonpolar organic solutions, which uses, in an amount at or exceeding stoichiometric to the total number of halogen groups, a reagent comprised of an alkali metal hydroxide and a polyalkylene glycol or a monocapped polyalkylene glycol alkyl ether.

Way, U.S. Pat. No. 4,764,256 describes a method for the removal of PCBs from contaminated oil, through the use of continuous solvent extraction.

Streck et al., U.S. Pat. No. 4,776,947 discloses a method for dehalogenation of halogenated organic compounds in hydrocarbon oils through the use of alkali or alkaline earth alcoholates having at least 6 carbon atoms.

Many of the previous references have involved the use of a reagent derived from the reaction of an alkali metal or alkali metal hydroxide. These references teach the combination of such a reagent, in an amount at or above stoichiometric with respect to the total number of halogen groups, with a solution containing the contaminating halogenated hydrocarbon. Most teach the use of substantially elevated temperatures.

Airs et al., British Patent Specification 618,189 discloses dehydrohalogenation of dihalogen alkenes and monohalogen alkenes to produce alkynes through the use of glycol monoalkylether alcoholates.

The use of crown ethers as phase transfer catalysts in chemical reactions, including dehalogenation reactions, is known in the art.

Oshawa and Oishi, J. Inclusion Phenomena 2: 185–194 (1984), discloses anaerobic reductive defluorination of alkyl fluorides in a variety of aprotic solvents, using dicyclohexano-18-crown-6 and potassium metal.

Oshawa and Oishi, Tetrahedron Letters 22: 2583–2586 (1981), discloses the use of crown ethers and alkali metals in toluene or diglyme in a reducing environment to dehalogenate alkyl halides.

Thus, those references teach reductive dehalogenation in the presence of crown ethers.

Gokel, et al., J. Org. Chem. 48: 2837–2842 (1983) discloses dehalogenation of chlorooctane using as phase transfer agents either crown ethers, oligoethylene glycols, or monomethyl or dimethyl ethers of oligoethylene glycols, and cyanate as the nucleophile.

Mariani, et al., J. Chem. Research (S), (1978), p. 392, discloses dehalogenation of 1-chloro-2,4-dinitrobenzene using potassium methoxide as nucleophile and shows a 300-fold increase in the reaction rate by using crown ethers as catalysts.

Litvak and Shein, Zhurnal Organicheskoi Khimii 12: 1723–1727 (1976) discloses increased dehalogenation of p-nitrobromobenzene through the use of crown ether catalysts in conjunction with a potassium phenolate nucleophile in solvents having low polarity.

Thus, those references involve the use of phase transfer agents, including crown ethers, together with nucleophilic agents to substitute the nucleophile for a halogen constituent of an organic compound that is activated for nucleophilic attack.

Hiratani et al., Israel Journal of Chemistry 18: 208–213 (1979) discloses the use of phase transfer agents, including oligoethyleneglycol ethers and cryptands, together with potassium acetate nucleophile, for the dehalogenation of benzyl chloride by nucleophilic substitution.

BRIEF SUMMARY OF THE INVENTION

This invention is directed toward an improved method for detoxifying waste materials containing halogenated hydrocarbons. More specifically the invention provides an improved chemical process for dehalogenating halogenated organic compounds.

An object of this invention is to provide an efficient and effective chemical process that will remove one or more halogens from a variety of halogenated organic compounds. For purposes of this invention, "substantially dehalogenate" means to remove one or more halogens from at least about 80 percent of the halogenated hydrocarbon molecules present.

Another object of the invention is to provide a process that is more cost effective than existing chemical processes for the dehalogenation of halogenated organic compounds.

Thus, an object of the invention is to identify more efficient chemical reagents or catalysts for such a process, thereby allowing reduced amounts of reagents to be used in the process. Additionally, an object of the invention is to provide reagents or catalysts that would allow the process to proceed at lower temperatures, without requiring the reaction to proceed for longer periods of time. The combined effect of reduced use of reagents and elimination or reduction of the need to heat the reaction mixture provides a substantial savings in cost without sacrificing effectiveness.

An embodiment of the invention provides for the dehalogenation of halogenated hydrocarbons present in a waste material through a method comprising the following steps:

(a) mixing the waste material comprising one or more halogenated organic compounds with a hydroxide of an alkali or alkaline earth metal or aluminum and 2-methoxyethanol; and (b) incubating the mixture at a temperature and for a period of time sufficient to substantially dehalogenate the halogenated organic compounds present in the waste material.

Another embodiment of the invention provides for the preformation of a metal alcoholate derived from 2-methoxyethanol prior to incubation of such reagent with the contaminated waste material. This embodiment comprises the steps of:

(a) mixing together a hydroxide of an alkali or alkaline earth metal or aluminum with 2-methoxyethanol;
(b) incubating together the preparation of (a) at a temperature and for a time sufficient to allow substantially complete formation of a reagent comprising the metal alkoxide derivative of 2-methoxyethanol;
(c) adding the reagent from (b) to a waste material comprising one or more halogenated organic compounds, thus forming a reaction mixture; and
(d) incubating the reaction mixture at a temperature and for a period of time sufficient to substantially dehalogenate the halogenated organic compounds present in the waste material.

In another embodiment a preformed metal alcoholate derived from an alkali or alkaline earth metal hydroxide and 2-methoxyethanol is mixed together with a waste material comprising one or more halogenated organic compounds, thus forming a reaction mixture which is then incubation at a temperature and for a period of time sufficient to substantially dehalogenate organic compounds present in the waste material.

In each of these embodiments, the efficiency of the process may be increased by the addition of a crown ether phase transfer agent catalyst. In embodiments employing crown ether phase transfer catalysts, the efficiency of the process is sufficiently enhanced to allow the use of metal alcohlates derived from alcohols other than 2-methoxyethanol. These embodiments thus allow the use of any simple alcohol or glycol which would form with an alkali or alkaline earth metal hydroxide a reagent which, in the absence of the phase transfer catalyst, would far less efficiently carry out the nucleophilic attack upon the halogenated organic compound.

The present invention provides more cost efficient means of dehalogenating halogenated hydrocarbons through the use of hydroxides of alkali or alkaline earth metals or aluminum, and 2-methoxyethanol, or through the use of alkali or alkaline earth metals or aluminum, and methanol or other alcohols in the presence of phase transfer agents. Such savings in cost result from the ability to use less reagent or to carry out the process at lower temperatures. The savings in reagent and energy are made possible through the discoveries that (1) 2-methoxyethanol surprisingly acts as a more effective reagent than does any other glycol monoalkyl ether, and (2) methanol and other alcohols are far more effective reagents when phase transfer agents are used as catalysts.

Specific preferred embodiments of the present invention will become evident from the following more detailed description of certain preferred embodiments and the claims.

DETAILED DESCRIPTION OF THE PREFERRED EMBODIMENTS

The present invention provides for the economical dehalogenation of halogenated hydrocarbons. Economy can be achieved through the use of methods that utilize lower temperatures and/or smaller quantities of reagents than existing procedures. This is made possible by either utilizing the reagent 2-methoxyethanol, which is superior to prior specifically described reagents, or by using phase transfer agents to increase the efficiency of 2-methoxyethanol or other reagents.

The method of the invention is effective for detoxifying soils, other solids, or liquids that are contaminated with halogenated hydrocarbons by dehalogenating such halogenated hydrocarbons. A variety of halogenated hydrocarbons may be dehalogenated by the method of the invention, including, but not limited to PCBs, polybrominated biphenyls (PBBs), polychlorinated dibenzodioxins, polychlorinated dibenzofurans, halobenzenes, dichlorodiphenyltrichloroethane (DDT), ethylene dibromide, aldrin, dieldrin, toxaphene, and the like, or mixtures thereof. The contaminating halogenated hydrocarbons may be present in soils, other solids, or liquids at concentrations from about 1 part per billion to about 100%. When contaminated liquids are used, the method of the invention may be practiced upon such liquids directly. When contaminated soils or other solids are to be treated, such soils or other solids will be first mixed in a liquid and then treated by the method of the invention.

The contaminated substances are detoxified through the dehalogenation of the halogenated hydrocarbons. This is achieved through a reaction in the presence of a crown ether phase transfer agent, between the halogenated hydrocarbon and a metal alcoholate reagent derived from the reaction of an alcohol and an alkali or alkaline earth metal or aluminum. Such a reagent can be represented by the structural formula $$M—[O—(CH_2)_yZ]_n$$

where Z=—H, —$CH_3$, or $CH_2$—$CH_3$, or —$OR_3$ and y=1 to 200,
where R=a $C_1$ to $C_4$ aliphatic hydrocarbon, and
where M=an alkali metal selected from the group consisting of lithium, sodium, potassium, rubidium and cesium and n=1,
or where M=an alkaline earth metal selected from the group consisting of magnesium, calcium, strontium and barium and n=2,
or where M=aluminum and n=3.

In certain embodiments the crown ether may be omitted, in which case the structural formula set forth for the reagent is further limited to where y=2 and Z=—$OCH_3$.

The reaction between the above reagent and the halogenated hydrocarbon (R—X), results in the derivative R—O—$(CH_2)_y$—Z and M—X, where R represents the hydrocarbon and X represents the halogen.

The concentration of the alkali or alkaline earth metal or aluminum alcoholate of the alcohol to be used will vary with the concentration of the contaminating halogenated hydrocarbons present in the soil or liquid to be treated. The ratio between the reagent and halogenated hydrocarbon may also vary. The method of the invention is carried out at temperatures, and for times sufficient to substantially dehalogenate the halogenated hydrocarbons present in the contaminated liquid or soil. The time for which the method is utilized to substantially dehalogenate halogenated hydrocarbons varies inversely with the temperature employed. At preferred temperatures, substantial dehalogenation occurs within about five hours.

In a preferred embodiment of the invention, the formation of the alkali or alkaline earth metal or aluminum alcoholate of 2-methoxyethanol or other alcohol may take place as the reaction with the halogenated hydrocarbons proceeds, i.e., the hydroxide of an alkali or alkaline earth metal or aluminum, the 2-methoxyethanol or other alcohol, and the liquid containing the halogenated hydrocarbon may be added together at approximately the same time. In another preferred embodiment of the invention, the alkali or alkaline earth metal or aluminum alcoholate may be formed prior to the reaction with the halogenated hydrocarbon by mixing together the hydroxide of an alkali or alkaline earth metal or aluminum with the 2-methoxyethanol and incubating together at a temperature from about 20° C. to about 135° C. and for a time from about 15 minutes to about 9 hours, thus allowing formation of the metal alcoholate prior to the addition of the halogenated hydrocarbon.

The alkali metals used in the method of the invention include lithium, sodium, potassium, rubidium, and cesium. The alkaline earth metals used in the method of the invention include magnesium, calcium, strontium and barium. Alkali metals, alkaline earth metals and aluminum are each used in the metal, metal hydride, or metal hydroxide form for the purposes of the present invention.

The ability to use smaller quantities of reagents than is required for other dehalogenation processes and the ability to practice the method of the invention at temperatures lower than those described for other dehalogenation processes without substantial loss of effectiveness, provides for an economical and useful alternative to previously accepted practices relating to the destruction of halogenated hydrocarbons. These unexpected features are made possible by the surprising discoveries that the metal alcoholate of 2-methoxyethanol is a more efficient reagent for the dehalogenation of halogenated hydrocarbons than any other glycol monoalkyl ether and that other alcohols are rendered much more efficient in this method when crown ether phase transfer agents are used.

When crown ether phase transfer catalysts are used in the methods of the invention, metal alcoholate nucleophiles that are very poor dehalogenating agents in the absence of crown ethers become very useful dehalogenating agents. For example, potassium methoxide is a very poor dehalogenating agent in the absence of crown ethers. In the presence of crown ethers, however, potassium methoxide becomes a highly effective dehalogenating agent.

A variety of crown ethers and other ion-binding macrocyclic compounds are known in the art (see e.g., Christensen et al., Chemical Reviews 74:350–384 (1974)). However, variation in effectiveness is observed between different crown ethers in the methods of the invention. For example, 18-crown-6 is a more effective catalyst of potassium methoxide-mediated dehalogenation than either cis-dicyclohexano-18-crown-6 or dibenzo-18-crown-6.

The catalytic properties of crown ether phase transfer agents in nucleophilic dehalogenation of halogenated organic compounds makes possible efficient dehalogenation of compounds which are not activated for nucleophilic substitution, and which would consequently resist nucleophilic dehalogenation in the absence of the phase transfer agent. The use of crown ether phase transfer catalyst therefore facilitates the dehalogenation of unactivated halogenated aromatic compounds. For purposes of the invention, "unactivated halogenated aromatic compounds" refers to halogenated aromatic compounds that do not contain any electron withdrawing constituents on the aromatic ring(s) other than the halogen groups. Such unactivated halogenated aromatic compounds would include PCBs, PCDDs, PCDFs and chlorobenzenes, wherein the PCBs, PCDDs, PCDFs and chlorobenzenes do not contain any non-halogen electron withdrawing groups on the aromatic rings.

Those skilled in the art will recognize that waste materials contaminated with halogenated aromatic compounds may contain a mixture of halogenated aromatic compounds, wherein the mixture may include the unactivated halogenated aromatic compounds envisioned by the invention, as well as activated halogenated aromatic compounds, i.e., halogenated aromatic compounds having electron withdrawing constituents other than halogen groups on the aromatic ring. In the case of such mixtures, methods of the invention provides an effective means of dehalogenating all halogenated aromatic compounds in the mixture, including the unactivated halogenated aromatic compounds. Thus, the invention specifically includes the treatment of waste materials contaminated with mixtures of halogenated aromatic compounds, so long as the mixture contains at least some unactivated halogenated aromatic compounds envisioned by the invention.

The following examples are provided as means for illustration and are not limiting in nature:

EXAMPLE 1

A 500 ml three neck round bottom flask was equipped with a reflux condenser, heating mantle and magnetic stirrer. To the flask were added 18.15 g 1,3,5-trichlorobenzene (TCB), 15.22 g 2-methoxyethanol, 13.20 g potassium hydroxide, 3.86 g biphenyl (as an internal standard), and 30 ml toluene. The above were stirred and heated to reflux for a total of 6 hours. Samples were removed at hourly intervals, washed with water and dried over anhydrous magnesium sulfate. The samples were then analyzed by gas chromatography (gc). After one hour, 63% of the TCB had been destroyed. The identity of the product of the reaction, 3,5-dichloro-1-(2-methoxyethoxy)benzene, was confirmed by gas chromatography/mass spectrometry (gc/ms). After 5 hours, 99% of the TCB was converted, and within the next hour, the level of TCB was reduced to below the limit of detection (<0.1%).

COMPARATIVE EXAMPLE 2

A reaction of 18.15 g TCB was carried out as in Example 1, except that the 2-methoxyethanol was replaced with 18.02 g 2-ethoxyethanol. After 12 hours at reflux, 97% of the TCB was destroyed.

COMPARATIVE EXAMPLE 3

A reaction of 18.15 g TCB was carried out as in Example 1, except that the 2-methoxyethanol was replaced with 18.02 g 1-methoxy-2-propanol. After 12 hours at reflux, 69% of the TCB was destroyed.

EXAMPLE 4

A 250 ml three neck flask was equipped with reflux condenser, mechanical stirrer and thermometer. To the flask was added 40.00 g of a polychlorinated biphenyl (PCB)-contaminated transformer oil, which contained 256,600 ppm PCBs. To this was added, with stirring, 31.17 g 90% potassium hydroxide, 38.05 g 2-methoxyethanol, and 40.00 g of mineral oil as a solvent. The entire reaction mixture was heated in an oil bath with stirring to a temperature of 115°±5° C. for 5 hours. At the end of this period, a sample aliquot was removed, extracted with hexane/acetone (9:1), and further diluted with hexane, followed by a sulfuric acid wash and successive hexane dilutions. Analysis by gc revealed the PCBs concentration to be reduced to 4,600 ppm (98% PCB destruction).

EXAMPLE 5

To a 250 ml round bottom three neck flask equipped with mechanical stirrer, condenser and thermometer were added 31.17 g of potassium hydroxide and 38.05 g 2-methoxyethanol. These were heated to 115°±5° C. with stirring for 30 minutes to pre-form the potassium ethylene glycol monomethyl ether derivative (KGME, 57.09 g). The contaminated oil (40.00 g, 256,600 ppm PCBs) was added, and the reaction mixture continued to stir at 115°±5° C. for 5 hours. Analysis at the end of this period revealed that the PCBs concentration was reduced to 10,200 ppm.

COMPARATIVE EXAMPLE 6

The reaction of Example 5 was repeated using 57.09 g of the potassium derivative of polyethylene glycol 400 (KPEG, pre-formed from 52.13 g polyethylene glycol 400 and 7.31 g potassium hydroxide), in place of the KGME. At the end of 5 hours, 17,900 ppm PCBs remained. Thus for equal weights of KGME vs KPEG, a known dehalogenation reagent, a significantly higher level of destruction of PCBs was obtained using KGME.

EXAMPLE 7

In a 250 ml round bottom three neck flask equipped with condenser, thermocouple and mechanical stirrer was added 102.0 g of a contaminated oil which contained 600,000 ppm PCBs, a total of 722 ppb polychlorinated dibenzodioxins (PCDDs, of which 40 ppb was attributed to the 2,3,7,8-tetrachloro isomer) and 2,725 ppb polychlorinated dibenzofurans (PCDFs). To this were added 77.6 g of 2-methoxyethanol and 39.8 g of potassium hydroxide. The reaction mixture was stirred and heated to 115°±1° C. for 5 hours. At the end of this time, an aliquot was removed for analyses of the PCBs, PCDDs and PCDFs. The PCBs concentration was reduced to 36,400 (95% destruction), while the PCDDs concentration was reduced to <4.5 ppb (>99.4% destruction of dioxins, of which the 2,3,7,8-tetrachloro isomer was reduced to below the limit of detection, i.e. <1 ppb). The PCDFs concentration was reduced to 3 ppb (99.9% destruction).

EXAMPLE 8

A 250 ml three neck flask was equipped with a reflux condenser, mechanical stirrer and thermometer. To the flask was added 100.00 g of a polychlorinated biphenyl (PCB)-contaminated transformer oil, which contained 256,600 ppm PCBs (about 1:1:3 of aroclors 1242, 1254 and 1260, respectively). To this was added, with stirring, 38.44 g 2-methoxyethanol and 33.27 g 90% potassium hydroxide. The entire reaction mixture was heated in an oil bath with stirring, to a temperature of 115°±5° C. for 3.5 hours. An exotherm to about 135° C. occurred within fifteen minutes of initial heating, but the internal reaction temperature fell to 115° C. within the following half hour. At the end of the 3.5 hour period, a sample aliquot was removed, extracted with hexane/acetone (9:1), and further diluted with hexane, followed by a sulfuric acid wash and successive hexane dilutions. Analysis by gc (ecd) indicated a reduction of total aroclors to 45,200 ppm, with aroclors 1254 and 1260 being reduced below the limits of detection.

EXAMPLE 9

| | | |
|---|---|---|
| 1. | TCB | 29.032 g (0.16 mole) |
| 2. | Potassium methoxide (95% - adj. to 100%) | 11.81 g (0.16 mole) |
| 3. | 18-Crown-6 | 2.115 g (8.0 mmole) |
| 4. | Biphenyl | 6.1687 g (0.04 mole) |
| 5. | Toluene (distilled over $CaH_2$) | 110 ml |

Compounds 2–5 were added to a 500 mL 3-necked flask equipped with stirrer (air-driven) and reflux condensor. The mixture was heated to reflux and compound 1 was added.

Samples were analyzed for destruction of TCB (i.e., conversion to 3,5-dichloroanisole and 1-chloro-3,5-dimethoxybenzene) at various time points by gas chromatography/mass spectrometry. Destruction of TCB at each time point is shown below.

| Time | % TCB destroyed |
|---|---|
| 0 | 51 |
| 5 min | 82 |
| 1 hr | 91 |
| 2 hr | 93 |
| 3 hr | 95 |
| 4 hr | 96 |

COMPARATIVE EXAMPLE 10

Dehalogenation procedure was carried out exactly as in Example 9, except that the crown ether was omitted. Destruction of TCB was 8.9% at 0 time and 9.8% after four hours.

EXAMPLE 11

Dehalogenation procedure was carried out exactly as in Example 9, except that 0.16 mole sodium methoxide was substituted for potassium methoxide and 0.008 mole 15-crown-5 was substituted for 18-crown-6. Destruction of TCB at various time points is shown below.

| Time | % TCB destroyed |
|---|---|
| 0 | 0 |
| 5 min | 1 |
| 10 min | 5 |
| 15 min | 6 |
| 30 min | 9 |
| 45 min | 14 |
| 1.0 hr | 16 |
| 1.5 hr | 24 |
| 2.0 hr | 28 |
| 3.0 hr | 30 |
| 4.0 hr | 33 |

This illustrates that, while the sodium salt works, it is much less effective than the potassium salt for dehalogenation.

EXAMPLE 12

Dehalogenation procedure was carried out exactly as in Example 9, except that the reaction took place at ambient (room) temperature. After two hours 85% of the TCB was destroyed.

EXAMPLE 13

Dehalogenation procedure was carried out exactly as in Example 12, except that 110 mL mineral oil was substituted for toluene. After 16 hours only 15% of the TCB was destroyed. After 2 additional hours, with the temperature raised to 90° C., 90% of the TCB was destroyed. Thus higher temperatures are necessary when very apolar solvents are used.

EXAMPLE 14

Equimolar (0.08 mole) quantities of 1,3,5-trichlorobenzene (TCB) and potassium methoxide were stirred together and heated to reflux with 0.0008 mole (1 mole %) of either cis-dicyclohexano-18-crown-6 or dibenzo-18-crown-6 in 55 MI of toluene. We obtained 32.0% TCB destruction with the former reagent, and 21.7% with the latter, after 10 hours of reaction. With only one half the molar quantity of 18-crown-6 (0.5 mole %) as the catalyst, under the same reaction conditions, 79.7% TCB destruction occurred after 10 hours, and 75.3% was destroyed after only two hours under these reaction conditions. Furthermore, when the concentration of 18-crown-6 was reduced to 0.1 mole %, we still achieved 79.2% destruction, but the reaction period required to do so was 20 hours. After two hours, only 19.8% of the TCB was destroyed.

We claim:

1. A method for dehalogenating a waste material containing a halogenated aromatic compound wherein the halogenated aromatic compound contains no electron withdrawing constituents on any aromatic ring other than a halogen group, comprising the steps of:

(a) providing a reaction mixture comprising a crown ether phase transfer catalyst, the halogenated aromatic compound, a hydroxide of a metal selected from the group consisting of lithium, sodium, potassium, rubidium, cesium, magnesium, calcium, strontium, barium and aluminum, and an alcohol selected from the group consisting of ethanol and methanol, wherein said hydroxide and said alcohol react to form a metal alcoholate; and (b) incubating the reaction mixture at a temperature and for a period of time sufficient to substantially dehalogenate the halogenated aromatic compound.

2. The method according to claim 1, wherein the halogenated aromatic compound is selected from the group consisting of PCBs, PCDDs, PCDFs and TCB.

3. A method for dehalogenating a waste material containing a halogenated aromatic compound, wherein the halogenated aromatic compound contains no electron withdrawing constituents, other than halogen, on any aromatic ring, the method comprising the steps of:

(a) mixing a metal alcoholate selected from the group consisting of ethanolate and methanolate together with a crown ether phase transfer catalyst and the halogenated aromatic compound to form a reaction mixture; and (b) incubating the reaction mixture at a temperature and for a period of time sufficient to substantially dehalogenate the halogenated organic compound.

4. A method according to claim 3, wherein the halogenated aromatic compound is selected from the group consisting of PCBs, PCDDs, PCDFs and TCB.

* * * * *